US006006362A

United States Patent [19]

Walsh

[11] Patent Number: 6,006,362

[45] Date of Patent: Dec. 28, 1999

[54] COVER FOR HEADBAND SIZE REGULATOR

[76] Inventor: Dennis Walsh, 1902 Lydia Dr., Lafayette, Colo. 80026

[21] Appl. No.: 08/331,325

[22] Filed: Oct. 28, 1994

Related U.S. Application Data

[63] Continuation-in-part of application No. 08/037,096, Mar. 25, 1993, abandoned, which is a continuation of application No. 07/862,735, Apr. 3, 1992, abandoned.

[51] Int. Cl.[6] ..... A42B 1/24

[52] U.S. Cl. ..... 2/209.13; 2/181; 2/181.2; 2/181.4; 2/195.2; 40/329

[58] Field of Search ..... 2/171, 175.1, 181, 2/181.2, 181.4, 195.1, 195.2, 209.13, DIG. 11, 908, 909, 910, 911, 912, 913, 914, 915, 916, 917, 918, 919, 920; 24/306, 442; 40/329, 586, 594, 620, 630

[56] References Cited

U.S. PATENT DOCUMENTS 33,430 11/1861 Nunnery et al. .
3,688,348 9/1972 Klotz et al. ..... 24/306
5,003,640 4/1991 Pizzacar .
5,153,943 10/1992 Clement .
5,161,259 11/1992 Shorts .
5,282,278 2/1994 Miner .
5,287,559 2/1994 Christiansen et al. .
5,315,714 5/1994 Peters et al. .
5,386,592 2/1995 Checkeroski ..... 2/209.13
5,428,844 7/1995 Dougherty ..... 2/209.13
5,499,402 3/1996 Rose ..... 2/209.13

*Primary Examiner*—Diana Biefeld
*Attorney, Agent, or Firm*—Rick Martin

[57] ABSTRACT

A cover for a headband size regulator used on a typical baseball style cap or visor. The cover cushions the wearer's head against the gouging and discomfort of headband size regulator straps. The cover is aesthetically pleasing and allows the wearer to display easily attachable indicia, such as logos, emblems and words on the back of their hat. The wearer can use the cover on caps with varying strap widths and on single leather strap and clasp size regulators.

18 Claims, 2 Drawing Sheets

COVER FOR HEADBAND SIZE REGULATOR

CROSS REFERENCE PATENTS

This is a continuation in part of U.S. Application Ser. No. 08/037,096 filed Mar. 25, 1993, now abandoned. U.S. Application Ser. No. 08/037,096 was a continuation in part of U.S. Application Ser. No. 07/862,735 filed Apr. 3, 1992, now abandoned.

FIELD OF INVENTION

The present invention relates to headware that is size adjustable, and more particularly to improvements in the comfort and appearance of adjustable headware straps.

BACKGROUND OF THE INVENTION

Several types of headband size regulators are integral to the headband of adjustable visors and adjustable caps. Adjustable visors and caps employ various designs of headband size regulators which permit the wearer to quickly and easily adjust the size of the headband.

Most headband size regulators are the narrowest point in the circumference of the headband. One of several problems caused by the narrowness of the headband size regulator is increased constricting pressure where the headband size regulator contacts the wearer's head. Many people, especially those with thin hair or bald heads, find the pressure against their scalp from the headband size regulator extremely uncomfortable.

Furthermore, some headband size regulator designs consist of extruded vinyl straps with square edges that gouge the scalps of thin haired or bald users.

Cap and visor wearers often wear the bill or the visor to the rear of their head for unobstructed vision. When worn in this position, the headband size regulator is normally in contact with the wearer's forehead. The narrow headband size regulator applies pressure to the wearer's forehead, and can cause extreme discomfort, gouge and leave visible marks on the wearer's forehead.

Several popular headband size regulators consist of man-made materials which can cause the wearer to suffer allergic reactions. Headband size regulators made of leather straps can also provoke allergic reaction due to the chemical used to tan the leather.

While adjustable caps and visors are available in many appealing styles, fabrics and colors, their exposed headband size regulators are unsightly and aesthetically detracting. The following patents are representative of the art in this field:

U.S. Pat. Reissue No. 33,430 (1990) to Nunnery et al. discloses a detachable perspiration absorbing band for headgear. The perspiration band is secured around the existing band by a face to face engagement of a mating fasteners that are disposed in rows along the upper and lower edges of the perspiration band. The present invention uses aesthetically pleasing materials, is adjustable to different band widths and lengths, and does not use rows of mating fasteners.

U.S. Pat. No. 5,003,640 (1991) to Pizzacar discloses an advertising nameplate that partially conceals the adjustable straps of a conventional cap's headband. The advertising nameplate attaches to the outer surface of the adjustable straps. The present invention covers the inside as well as the outside of the adjustable straps, thereby, protecting the wearer's scalp from contact with the adjustable straps.

U.S. Pat. No. 5,153,943 (1992) to Clement discloses a flexible weather shield that attaches to a hat with a forward visor and a rear size adjuster. The shield is attached to the hat by an elastic band placed on top of the visor and by a rear hook and loop fastening strip that attaches around the rear adjustment straps. The present invention is not a weather shield.

U.S. Pat. No. 5,161,259 (1992) to Shorts discloses a protective neck covering garment that attaches to the rear adjustment strap of a conventional baseball cap. The protective garment attaches to the cap by an upper strap placed on top of the bill of the cap and by a rear fastening strap that is secured around the cap's adjustment straps. The present invention is not a protective neck covering garment.

U.S. Pat. No. 5,282,278 (1994) to Miner et al. discloses an emblem bearing accessory that attaches to the inside rear of a sized baseball style cap. The cap accessory has a relatively stiff emblem or indicia bearing panel that displays the indicia when it is folded upward or downward. The present invention does not require a stiff emblem bearing panel and is used with size adjustable baseball style caps.

U.S. Pat. No. 5,287,559 (1994) to Christiansen et al. discloses a semicircular fabric covered foam rubber pad that covers the hemispherical rear opening in a conventional style baseball cap. The foam pad is hinged in the middle and hook and loop fasteners are attached to one side of the pad. The pad then folds in half and is fastened around the cap's adjustable straps to completely cover the cap's rear opening. The present invention covers only the adjustable straps and does not obstruct the rear opening, allowing hair to pass through the opening.

U.S. Pat. No. 5,315,714 (1994) to Peters et al. discloses a method and apparatus for covering the adjustable straps used in apparel. The method and apparatus slide a tubular sheath over the cap's adjustable straps. The sheath is either formed from seamless neoprene or from a rectangle of material joined along one edge by a single seam. The preferred embodiment of the present invention is not a fixed size tube, rather, it consists of two pieces that allow for adjustment to band width and changing of displayed indicia. The alternative embodiment also allows the displayed indicia to be changed.

The present invention eliminates problems unanswered by the prior art. The present invention covers both the inside and the outside of the headband size regulator with soft, comfortable, and aesthetically attractive material. The present invention is not limited to the display on one indicia. Rather, the present invention's displayed indicia is easily interchangeable with alternative indicia. The present invention further provides an attachable sweat pad that is easily interchangeable with fresh sweat pads.

The present invention is also completely adjustable to any width of headband size regulator.

SUMMARY OF THE INVENTION

The primary object of the present invention is to provide a soft comfortable headband size regulator cover that snugly encircles the interior and exterior faces of the headband size regulator.

Another object of the present invention is to provide a cover for the headband size regulator which will reduce the tendency of the headband size regulator to gouge into the scalp of the wearer.

Another object of the present invention is to provide a cover for the headband size regulator which will help lessen the excessive pressure between the wearer's scalp and the headband size regulator.

Another object of the present invention is to provide a removable advertising surface on which many types of indicia can be displayed.

Another object of the present invention is to provide an advertising surface that the wearer can easily interchange with other indicia.

Another object of the present invention is to provide a headband size regulator cover that is adjustable to varying strap widths.

Another object of the present invention is to provide a removable sweatband member which can easily by attached to and removed from the interior face of the headband size regulator.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG.1 is a back plan view of a cap with an alternative tubular sleeve embodiment of the headband size regulator cover mounted on the adjustable straps of a headband size regulator.

FIG.2 is a top perspective view of a prior art visor with a headband size regulator.

FIG.3 is a rear plan view of the preferred soft wrap embodiment of the cover mounted on a cap's headband size regulator.

FIG.4 is a cross-sectional view of an alternative embodiment of a soft wrap cover mounted on a headband size regulator wherein the cover is made of hook-negative material annealed to a foam backing.

FIG. 5 is a cross-sectional view taken along line 5—5 of FIG. 1 showing the alternative tubular sleeve embodiment of the headband size regulator cover.

FIG.6 is a cross-sectional view along line 6—6 of FIG.3 of the preferred soft wrap embodiment of the cover mounted on a headband size regulator where the body of the cover is made solely of hook-negative material.

FIG.7 is a cross-sectional view of an alternative embodiment of a soft wrap cover mounted on a headband size regulator where the body of the cover is made of hook material.

FIG. 8 is a cross-sectional view of an alternative view of a soft wrap cover mounted on a headband size regulator where the body of the cover is made of conventional loop material.

FIG.9 is a bottom perspective view of the preferred embodiment of the soft wrap cover mounted on a headband size regulator where the headband size regulator consists of a strap and clasp mechanism.

FIG. 10 is a cross-sectional view of the alternative tubular sleeve embodiment mounted on a headband size regulator with an attached sweatband and attached indicia.

Figure 1:
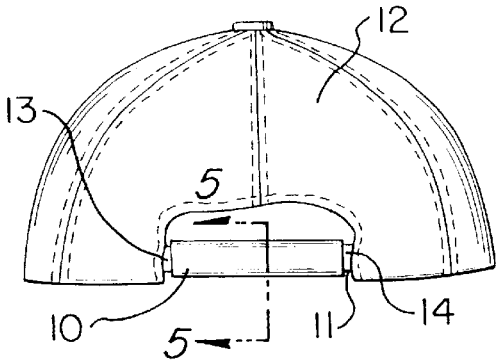
FIGS. 1 through 10 show five embodiments, including the preferred soft wrap embodiment, of the present invention.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

In the drawings, a headband size regulator cover for an adjustable cap or visor is set forth. The cover may be used to substantially cover the interior and exterior surfaces of the headband size regulator on adjustable caps and visors.

Figure 3:
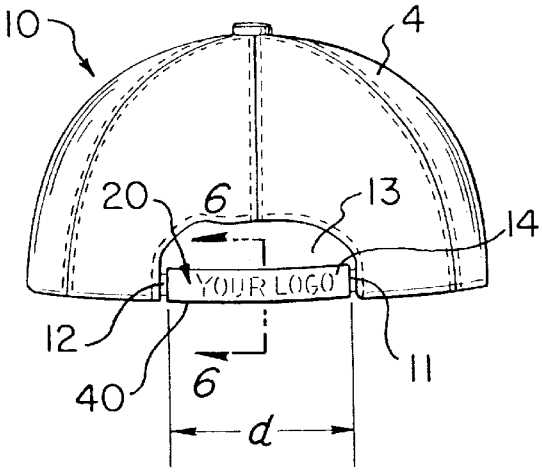

Referring first to FIG.3 a back plan view of a cap 10 with a cover 20 mounted on the adjustable straps 11, 12 of a headband size regulator 40 is shown. The cover 20 has a length d which substantially covers the length of the headband size regulator 40. The cover 20 fits closely around the headband size regulator 40. The fitting hole 13 of cap 10 is, therefore, not encroached by the cover 20. Thus, cap wearers may place braids or ponytails through the fitting hole 13 allowing hair to hang freely outside the cap 10.

The cover 20 also comprises an advertising surface 14 on which indicia such as words, logos, emblems, designs, sports team names, etc. can be displayed. The indicia can be embroidered, silk-screened, painted, glued, etc. onto the advertising surface 14.

Figure 6:
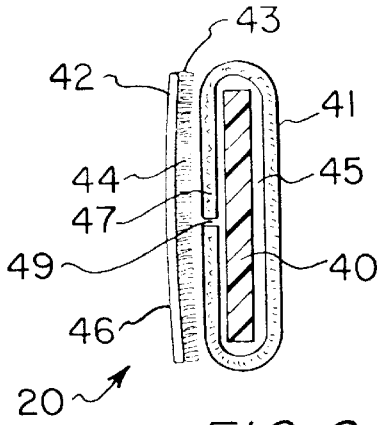

Referring next to FIG.6, a cross-sectional view of the preferred embodiment of the cover 20 mounted on a headband size regulator 40 along section 6—6 of FIG. 3 is shown. The preferred embodiment consists of a wrap 20 and an advertising member 42.

The wrap 20 consists of a rectangular piece of hook-negative material that binds securely to the hooks of conventional hook and loop material. Conventional hook material being made of fabric to which numerous small hooks have been attached. Hook negative material being any material to which the hook material will anneal. In the preferred embodiment, this hook-negative material is comprised of an ultra thin nylon cloth with flocking on one side. This hook negative cloth is 1/32 of an inch thick and available under the name Ouimet 2100 from the company Ouimet in Nashville, Tennessee. This ultra thin hook negative material is also available under the name Velotex™ from the makers of VELCRO®.

The advertising member 42 consists of a strip of conventional hook material on its inner face 43 and a backing on its outer face 44. Indicia can be displayed on the outer face 44.

The wrap 20 forms a circular internal channel 45 around the head band size regulator 40 when the hook material on the inner face 43 of the advertising member 42 hooks the opposite longitudinal edges 46, 47 of the wrap 20. The diameter of the circular internal channel 45 can be decreased by overlapping the longitudinal edges 46, 47 and then securing the wrap 20 by attaching the advertising member 42. The diameter of the circular internal channel 45 can be increased by widening the gap 49 between the longitudinal edges 46. 47. Thus, wrap 20 can adjust to varying strap widths of headband size regulators.

Wearers can also vary the indicia displayed on the cover 20 by simply removing one advertising member 42 and replacing with another advertising member having different indicia.

Figure 4:
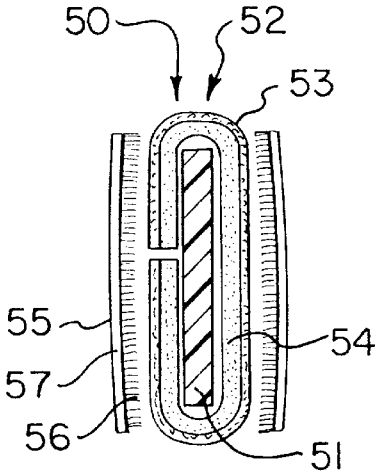

Referring next to FIG.4 a cross-sectional view of an alternative embodiment of the cover 50 mounted on a headband size adjuster 51 is shown. The wrap 52 of cover 50 consists of hook-negative outer surface 53 annealed to a foam inner surface 54. The wrap 52 is secured around the headband size adjuster 51 by an advertising member 55 with a hook covered inner face 56 and an advertising outer surface 57.

Figure 7:
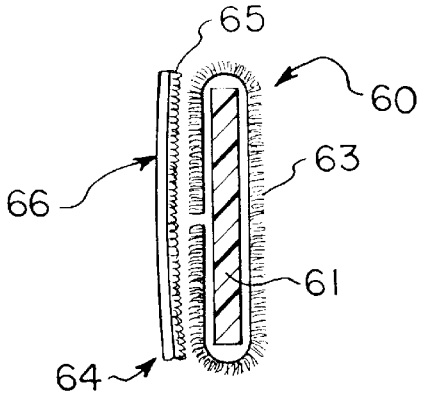

Referring next to FIG.7 a cross-sectional view of another alternative embodiment is shown. Cover 60 is mounted on a headband size regulator 61. In this embodiment, the wrap 63 is composed of conventional hook material rather than hook-negative material. The wrap 63 is secured around the headband size regulator 61 by an advertising member 64. The advertising member 64 has a hook negative inner surface and an outer surface 66 on which indicia can be displayed.

Figure 8:
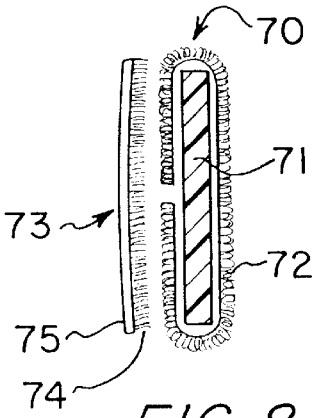

FIG. 8 is a cross-sectional view of another alternative embodiment. Cover 70 is mounted on a headband size regulator 71. In this embodiment, the cover 70 consists of a wrap 72 composed of traditional loop material. Traditional loop material consisting of fabric to which numerous tiny loops have been annealed. The wrap 72 is secured around the headband size regulator 71 by an advertising member 73. The advertising member 73 has a hook covered inner surface 74 and an outer surface 75 on which indicia can be displayed.

Referring next to FIG.1 a back plan view of another alternative embodiment is shown. Cover 10 mounted on headband size regulator 11 of cap 12 is shown. Cover 10 consists of a sleeve of ultra thin hook negative nylon material. Both ends 13 and 14 are open to permit insertion and passage of the headband size regulator 11 through the cover's internal channel 80 shown in FIG. 5.

Figure 5:
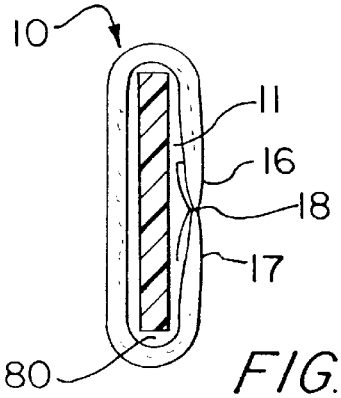

Referring next to FIG. 5 a cross-sectional view along line 5—5 of FIG. 1 shows the tubular sleeve embodiment of cover 10 mounted on headband size regulator 11. The cover 10 consists of a rectangular piece of ultra thin hook negative nylon material joined along its opposing longitudinal ends 16, 17 by a seam 18. The seam may be sewn, glued, stapled or secured by any similar means.

Figure 10:
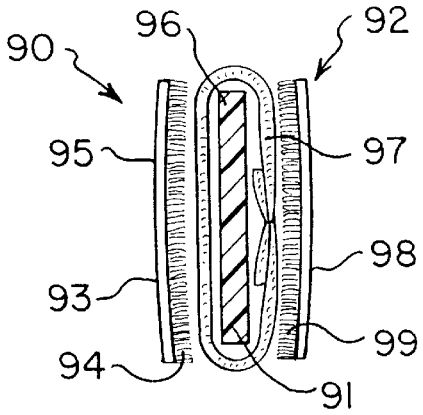

Referring next to FIG. 10 a cross-sectional view of another tubular sleeve embodiment is shown. Cover 90 is mounted on headband size regulator 91. Cover 90 is substantially the same as the embodiment shown in FIG.5 with the addition of a removable indicia bearing member 93 and a removable sweatband 92.

The indicia bearing member 93 is attached to the surface 96 of the tubular sleeve cover 20 that faces outward from a wearer's head. The indicia bearing member 93 consists of a hook covered inner surface 94 and an indicia bearing outer surface 95. The displayed indicia can be easily varied without removing the cover 90 from the headband size regulator 96 by substituting different indicia bearing members with the original 93.

The optional sweatband member 92 is secured to the surface 97 of the tubular sleeve cover 90 that faces the wearer's head. The sweatband 92 is comprised of a user selectable non-allergic perspiration absorbing material on its outer surface 98 and a hook covered inner surface 99. Once again the sweatband member 92 can easily be replaced with a fresh on without removing the cover 90 from the headband size regulator.

Figure 2:
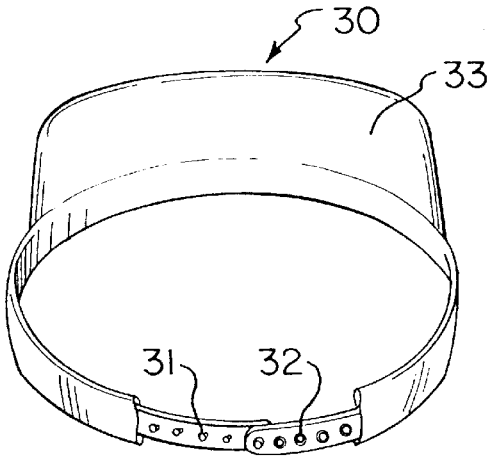
FIG. 2 (PRIOR ART)

Referring next to FIG.2 a top perspective view of a visor 30 having a pair of headband size regulator straps 31, 32 and a front bill 33 is shown. The embodiments of FIGS. 1, 3 through 8 and 10 can be also be mounted on the adjustable straps 31, 32 of the visor 30.

Figure 9:
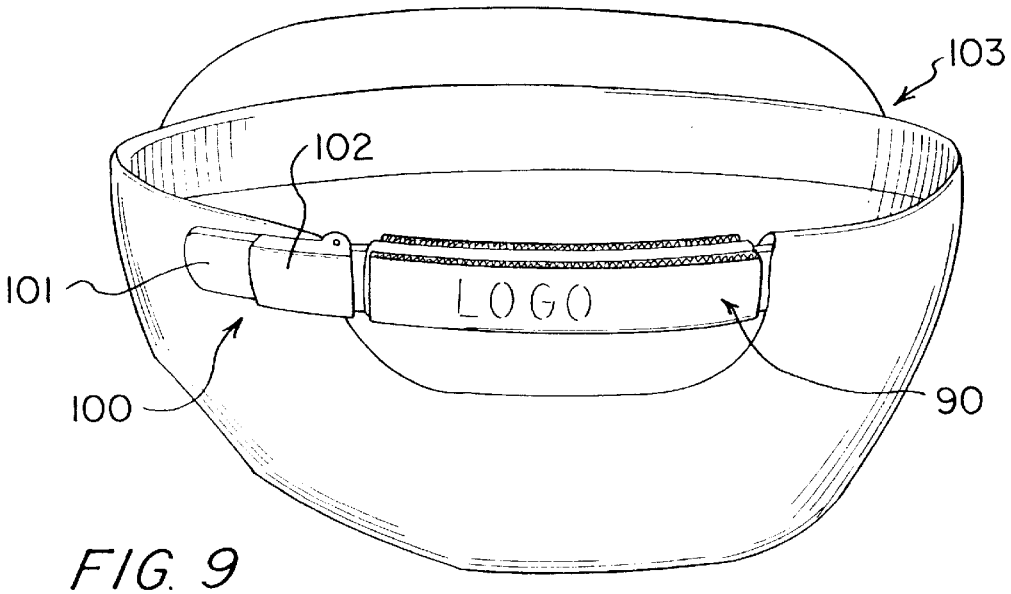

Referring next to FIG.9 a bottom perspective view of cover 90 mounted on a headband size regulator 100 of cap 103 is shown. Headband size regulator 100 consists of a leather strap 101 which threads through clasp 102 when the clasp 102 is in the open position. When clasp 102 is in the closed horizontal position the strap 101 is held securely in place.

Although the present invention has been described with reference to preferred embodiments, numerous modifications and variations can be made and still the result will come within the scope of the invention. No limitation with respect to the specific embodiments disclosed herein is intended or should be inferred.

I claim:

1. For headgear having a pair of exposed headband size regulator straps with an inner and an outer surface, which when fitting by engaging comprise a fitting length and a fitting hole, the improvement comprising:

a soft wrap the length of the fitting length having a snug and removable engagement around said pair of exposed headband size regulator straps so as not to protrude into the fitting hole;

said soft wrap further comprising a hook and loop fastening means;

a soft securing member the length of the fitting length; and said soft securing member further comprising a hook and loop securing means on an interior side, functioning to removably secure to the hook and loop fastening means of the soft wrap, and an outer advertising surface having a word and/or logos facing exteriorly.

2. The improvement of claim 1, wherein said soft wrap further comprises thin hook negative nylon.

3. The improvement of claim 1, wherein:

said soft wrap further comprises hook material; and said hook and loop securing means on said interior side of said soft securing member further comprises hook negative material.

4. A cover for covering a head band size regulator of a hat, comprising:

a soft wrap having a generally rectangular shape which further comprises a hook negative material on an exterior surface and two longitudinal edges:

said soft wrap may be snugly wrapped so as to encircle said headband size regulator of a hat, whereby said two longitudinal edges run parallel to one another;

an advertising member having a first and second side;

said first side further comprising a hook material; and said hook material of said first side of said advertising member removably connecting together each of said longitudinal edges along their exterior surfaces thereby forming a juncture.

5. The cover of claim 4, wherein:

said juncture further comprises a longitudinal gap between said longitudinal edges; and said cover being adjustable to a plurality of different headband size regulator strap widths by widening said longitudinal gap whereby said cover increases in diameter.

6. The cover of claim 5, further comprising an advertising indicia on said second side of said advertising member whereby said advertising indicia is visible from outside of said hat.

7. The cover of claim 4, wherein:

said juncture further comprises a longitudinal overlapping region; and said cover is adjustable to a plurality of different headband size regulator strap widths by increasing said longitudinal overlapping region whereby said cover decreases in diameter.

8. A wrapper for covering a headband size regulator of a hat in combination with a hat having a headband size regulator, comprising:

a tubular cover snugly encircling the headband size regulator of a hat:

said tubular cover further comprising a hook and loop material; and at least one attachable member, comprising a corresponding hook and loop material for removably attaching to the hook and loop material of said tubular cover.

9. The combination of claim 8, wherein the tubular cover further comprises a longitudinal juncture for adjusting the said tubular cover to fit a plurality of widths of headband size regulators.

10. The combination of claim 8, wherein the tubular cover further comprises a longitudinal seam.

11. The combination of claim 10, wherein the at least one attachable member comprises an indicia displaying surface.

12. For headgear having a pair of exposed headband size regulator straps with an inner and an outer surface, which when fitting by engaging, comprise a fitting length and a fitting hole, the improvement comprising:

a soft wrap the length of the fitting length having a snug and removable engagement around the pair of exposed headband size regulator straps so as not to protrude into the fitting hole;

said soft wrap further comprising a hook and loop fastening means;

a soft securing member the length of the fitting length;

said soft securing member further comprising a hook and loop securing means on an interior side, functioning to removably secure to the hook and loop fastening means of said soft wrap, and an outer advertising surface having a word and/or logos facing exteriorly; and further comprising a sweatband member having a hook and loop attachment means for attachment to a portion of said soft wrap covering said inner surface of the headband size regulator straps.

13. For headgear having a pair of exposed headband size regulator straps with an inner and an outer surface, which when fitting by engaging comprise a fitting length and a fitting hole, the improvement comprising:

a soft wrap the length of the fitting length having a snug and removable engagement around the pair of exposed headband size regulator straps so as not to protrude into the fitting hole;

said soft wrap further comprising a hook and loop fastening means;

a soft securing member the length of the fitting length;

said soft securing member further comprising a hook and loop securing means on an interior side, functioning to removably secure to the hook and loop fastening means of said soft wrap, and an outer advertising surface having a word and/or logos facing exteriorly; and said soft wrap further comprises a hook and loop material annealed to a pliable foam backing.

14. A cover for a headband size regulator of a hat, comprising:

a soft wrap having a generally rectangular shape which further comprises a hook negative material on an exterior surface and two longitudinal edges;

said soft wrap may be snugly wrapped so as to encircle the headband size regulator thus resulting in the two longitudinal edges running parallel with the headband size regulator;

an advertising member having a first and second side;

said first side further comprising a hook material;

said hook material of said first side of said advertising member removably connecting together each of said longitudinal edges along their exterior surfaces thereby forming a juncture;

said juncture further comprises a longitudinal gap between said longitudinal edges;

said cover being adjustable to a plurality of different headband size regulator strap widths by widening said longitudinal gap whereby said cover increases in diameter;

said juncture further comprises a longitudinal overlapping region;

said cover is adjustable to a plurality of different headband size regulator strap widths by increasing said longitudinal overlapping region whereby said cover decreases in diameter;

further comprising an advertising indicia on said second side of said advertising member whereby said advertising indicia is visible from outside of the hat;

a sweat pad having said hook material on a first side and an absorbent material on a second side; and said first side of said sweat pad removably attaching to said hook negative material of said soft wrap whereby said absorbent material may be positioned to face a hat user's head.

15. A cover for a headband size regulator of a hat, comprising:

a soft wrap having a generally rectangular shape which further comprises a hook negative material on an exterior surface and two longitudinal edges;

said soft wrap may be snugly wrapped so as to encircle the headband size regulator thus resulting in the two longitudinal edges running parallel with the headband size regulator;

an advertising member having a first and second side;

said first side further comprising a hook material;

said hook material of said first side of said advertising member removably connecting together each of said longitudinal edges along their exterior surfaces thereby forming a juncture;

said juncture further comprises a longitudinal gap between said longitudinal edges;

said cover being adjustable to a plurality of different headband size regulator strap widths by widening said longitudinal gap whereby said cover increases in diameter;

said juncture further comprises a longitudinal overlapping region;

said cover is adjustable to a plurality of different headband size regulator strap widths by increasing said longitudinal overlapping region whereby said cover decreases in diameter;

further comprising an advertising indicia on said second side of said advertising member whereby said advertising indicia is visible from outside of the hat;

a sweat pad having said hook material on a first side and an absorbent material on a second side;

said first side of said sweat pad removably attaching to said hook negative material of said soft wrap whereby said absorbent material may be positioned to face a hat user's head; and wherein said hook negative material is thin hook negative nylon.

16. A cover for a headband size regulator of a hat, comprising:

a soft wrap having a generally rectangular shape which further comprises a hook negative material on an exterior surface and two longitudinal edges;

said soft wrap may be snugly wrapped so as to encircle the headband size regulator thus resulting in the two longitudinal edges running parallel with the headband size regulator;

an advertising member having a first and second side;

said first side further comprising a hook material;

said hook material of said first side of said advertising member removably connecting together each of said longitudinal edges along their exterior surfaces thereby forming a juncture;

said juncture further comprises a longitudinal gap between said longitudinal edges;

said cover being adjustable to a plurality of different headband size regulator strap widths by widening said longitudinal gap whereby said cover increases in diameter;

said juncture further comprises a longitudinal overlapping region;

said cover is adjustable to a plurality of different headband size regulator strap widths by increasing said longitudinal overlapping region whereby said cover decreases in diameter;

further comprising an advertising indicia on said second side of said advertising member whereby said advertising indicia is visible from outside of the hat;

a sweat pad having said hook material on a first side and an absorbent material on a second side;

said first side of said sweat pad removably attaching to said hook negative material of said soft wrap whereby said absorbent material may be positioned to face a hat user's head; and wherein said hook negative material is conventional hook negative loop material.

17. A cover for a headband size regulator of a hat, comprising:

a soft wrap having a generally rectangular shape which further comprises a hook negative material on an exterior surface and two longitudinal edges;

said soft wrap may be snugly wrapped so as to encircle the headband size regulator thus resulting in the two longitudinal edges running parallel with the headband size regulator;

an advertising member having a first and second side;

said first side further comprising a hook material;

said hook material of said first side of said advertising member removably connecting together each of said longitudinal edges along their exterior surfaces thereby forming a juncture;

said juncture further comprises a longitudinal gap between said longitudinal edges;

said cover being adjustable to a plurality of different headband size regulator strap widths by widening said longitudinal gap whereby said cover increases in diameter;

said juncture further comprises a longitudinal overlapping region;

said cover is adjustable to a plurality of different headband size regulator strap widths by increasing said longitudinal overlapping region whereby said cover decreases in diameter;

further comprising an advertising indicia on said second side of said advertising member whereby said advertising indicia is visible from outside of the hat;

a sweat pad having said hook material on a first side and an absorbent material on a second side;

said first side of said sweat pad removably attaching to said hook negative material of said soft wrap whereby said absorbent material may be positioned to face a hat user's head; and wherein said hook negative material is annealed to a pliable absorbent foam backing.

18. For headgear having a pair of exposed headband size regulator straps with an inner and an outer surface, which when fitting by engaging comprise a fitting length and a fitting hole, the improvement comprising:

a soft wrap the length of the fitting length having a snug and removable engagement around said pair of exposed headband size regulator straps so as not to protrude into the fitting hole;

said soft wrap further comprising a hook and loop fastening means;

a soft securing member the length of the fitting length; and said soft securing member further comprising a hook and loop securing means on an interior side, functioning to removably secure to the book and loop fastening means of the soft wrap, and an outer advertising surface having a word and/or logos facing exteriorly; and further comprising a sweatband member having a hook and loop attachment means for attachment to a portion of said soft wrap covering said inner surface of said headband size regulator straps, wherein said soft wrap further comprises a hook and loop material annealed to a pliable foam backing.

* * * * *